US008052065B2

(12) United States Patent
Lackey

(10) Patent No.: US 8,052,065 B2
(45) Date of Patent: Nov. 8, 2011

(54) TAPERED HIGH PRESSURE ROTARY FEED VALVES

(75) Inventor: Raymond E. Lackey, Redmond, OR (US)

(73) Assignee: M.S.T. Corporation, Prineville, OR (US)

( * ) Notice: Subject to any disclaimer, the term of this patent is extended or adjusted under 35 U.S.C. 154(b) by 408 days.

(21) Appl. No.: 12/321,626

(22) Filed: Jan. 23, 2009

(65) Prior Publication Data

US 2009/0224195 A1 Sep. 10, 2009

Related U.S. Application Data

(60) Provisional application No. 61/068,298, filed on Mar. 5, 2008.

(51) Int. Cl.
*G05D 23/02* (2006.01)
*F16K 5/00* (2006.01)

(52) U.S. Cl. ..... 236/93 R; 251/304; 29/890.12

(58) Field of Classification Search ..... 236/93 R; 251/304; 29/890.12
See application file for complete search history.

(56) References Cited

U.S. PATENT DOCUMENTS

| | | | | |
|---|---|---|---|---|
| 2,816,693 | A | 12/1957 | Greaves et al. | |
| 3,101,853 | A | 8/1963 | Long et al. | |
| 3,130,879 | A | 4/1964 | Messing | |
| 3,273,758 | A | 9/1966 | Starrett | |
| 3,353,723 | A | 11/1967 | Wieleba | |
| 3,633,797 | A | 1/1972 | Graff | |
| 3,708,890 | A | 1/1973 | Weisselberg | |
| 3,750,902 | A | 8/1973 | Starrett | |
| 2002/0164392 | A1 * | 11/2002 | Kazmer et al. | 425/144 |

FOREIGN PATENT DOCUMENTS

EP 0732280 A1 9/1996

* cited by examiner

*Primary Examiner* — Marc Norman
(74) *Attorney, Agent, or Firm* — Chernoff Vilhauer McClung & Stenzel LLP

(57) ABSTRACT

A tapered rotary feed valve is manufactured or refurbished for use in feeding materials into a high temperature environment, so as to reduce the time and expense of break-in operation, by shaping the tapered bore of the valve body at ambient temperature to have greater clearance around the rotor in a sector of the valve body that is cooler when the valve is at stable operating temperature. As a result, when the valve first reaches operating temperature after being manufactured or refurbished the rotor and the bore of the valve body nearly fit and can quickly wear in to fit each other closely.

4 Claims, 9 Drawing Sheets

TAPERED HIGH PRESSURE ROTARY FEED VALVES

CROSS-REFERENCE TO RELATED APPLICATIONS

This application claims the benefit of U.S. Patent Application Ser. No. 61/068,298 filed Mar. 5, 2008.

TECHNICAL FIELD

This disclosure relates to improvements in tapered high pressure rotary feed valves and, more particularly, to construction and overhaul of such valves so as to require a shorter time and less power to drive the valves for break-in after manufacture or overhaul.

BACKGROUND AND SUMMARY

Rotary material handling valves such as those disclosed, for example, in Starrett U.S. Pat. No. 3,273,758 and Starrett U.S. Pat. No. 3,750,902, are used for transferring particulate material into a pressurized environment at raised temperature. For example, such valves are used for feeding raw materials such as pulp wood chips and sawdust into a container of hot pulping liquor in the process of manufacturing paper. On a receiving side of such a valve, the chips are fed to the valve at temperatures near ambient atmospheric temperatures and at atmospheric pressure. The valves must deliver those materials into a container where temperatures and pressures are elevated significantly. It is desirable to feed the raw materials into the processing container continuously at high volume rates, but with a minimum loss of pressure from within the processing container.

Valves of the type with which this disclosure is concerned require close clearances between a tapered rotor and a surrounding housing when the valve is fully warmed up and operating in a stabilized continuously operating condition. Such valves may have rotors varying in diameter from 35 inches to over 40 inches along the length of the rotor.

Previous practice in the use of such rotary valves has included placement of the axis of rotation of the rotor of the valve in an eccentric location with respect to the tapered bore in the surrounding body of the valve when the valve is assembled at normal atmospheric temperature, and the valve has thereafter been operated with frequent adjustment during a break-in period during which the rotor and the opposing surfaces of the housing have worn each other until the rotor has become seated around the entire periphery of the housing with the desired close clearance so as to minimize leakage of gas under pressure from the processing container into which raw material is being fed by the valve.

The wear-in period includes axial movement of the rotor with respect to the body by means of an adjustable thrust bearing arrangement, and a considerable amount of material has to be worn away from the mating surfaces of the rotor and housing before the desired close fit is attained in a tapered rotary feed valve manufactured in accordance with Starrett U.S. Pat. No. 3,750,902. Since the rotor has to be moved axially into a position in contact with the housing, so that wear will occur where necessary, the power required to rotate the rotor during break-in is higher than is usual once a valve has been broken in, and leakage of pressurized gas or steam from the processing container occurs, wasting heat, during the break-in period.

The required wear-in period for such valves has been many hours long, often as much as two weeks.

As stated in Starrett U.S. Pat. No. 3,750,902, it has commonly been believed that an offset of the axis of rotation of the rotor was desired to accommodate elastic flexure of the rotor shaft and to accommodate take-up of clearances in the bearings themselves, so that the rotor would essentially be centered in the housing, with minimal clearance between mating surfaces of the rotor and housing, during operation of the valve. Excessive leakage into the end-bells had resulted from the misfit of the rotor in the valve body with the rotor bearings centered. The real reason the bottom sector was not sealing fast enough was the misfit at the rotor-to-body seal areas in the lower sector in a new valve. This was a result of the thermal profile of the body in a stabilized hot valve. The downwardly eccentric displacement of the rotor had the effect of reducing the amount of plugging in the ends, etcetera, long enough for the rotor to wear-in until the rotor was effectively "lapped" in to fit the bore at hot equilibrium. It should be noted, the problem of leakage was particularly problematical when users started using sawdust for furnish in the early 1970's.

The downwardly eccentric adjustment of the rotor axis caused the lower sector of the bore to wear-in to a close fit first. Quickly establishing a seal in the lower sector was paramount, because without it fines—especially sawdust—escaped past the seal at each end of the rotor in the bottom sector, causing end-bell plugging, excessive gas bypass into the inlet, and troublesome startups.

In the valve manufacturer's manuals, regrind was advised when the user finds the valve liner thickness varies 0.020". The user would find this condition every time the unit was taken apart, as a result of the wear during break-in because of the prescribed downwardly eccentric rotor shaft location.

Two primary causes may contribute to change in shape in a high pressure rotary valve: thermal profile variations and elastic deflection because of pressure differential across the valve. Both are related to properties of the materials of which the rotor and the housing are manufactured. It has been calculated that the strain of the housing, or body, of the valve because of pressure differential would be about seven millionths (0.000007) of an inch (insignificant for a Bauer rotary valve, the type of valve disclosed in the Starrett patents), far less than the offset, eccentrically downward placement of the axis of rotation of the rotors according to the manufacturer's recommendations for those valves.

As for possible deflection of the shaft, bending in response to pressure between the outlet and inlet sides of the valve, based on 150 pounds per square inch pressure differential across the valve, the maximum deflection in bending, determined by a finite elemental analysis of the rotor, is also much less than the recommended downward eccentric offset location of the shaft. Elastic deflection therefore does not require the use of an eccentric offset location of the axis of rotation of the rotor.

The real issue is one of thermal profiles in the materials of the housing and rotor to account for the shape and size of the housing and rotor in a condition of equilibrium once the valve has been in operation long enough to achieve its operating temperature during continuous operation.

What is desired, then, is an improved way to manufacture or overhaul and assemble such a rotary valve so that the time required for break-in is shorter and the valve is operable thereafter for a longer time.

In operation of a rotary feed valve, uniform heating of the rotor occurs because the rotor rotates over the heat source, the pulp digester or other container with which the rotary valve is used, because of the higher temperature of the materials under pressure within the container on which the valve is mounted. The housing, or body, of the high pressure rotary valve is bolted to the container, which is the heat source, and is therefore subject to a thermal gradient from the bottom of the valve toward its top. Additionally, as the temperature of the rotor increases, its initial taper angle increases, because the large end of the rotor, with a larger radius, expands by a larger distance than does the smaller end of the rotor.

Because the upper portion of the body of the valve never is heated to as high a temperature as the bottom portion, the internal radius of the body does not increase as much in the upper sector of its bore as in the lower sector.

Initial operation of such a high pressure rotary valve when new or refurbished to factory specifications requires the body bore to be worn into a shape matching that of the rotor, so that the valve minimizes pressure loss when it has reached its equilibrium temperature distribution after operating for a long enough time.

It takes about eight hours for a tapered high pressure rotary feed valve of the size used in pulp processing to reach thermal equilibrium under continuous operation. Ideally, when starting such a valve one would give the valve at least three to four hours in which to stabilize. With a shorter time allowed for starting operation of the valve the thermal gradient between the top and bottom of the valve becomes larger, and the distortion of the shape as a result of unequal temperatures is greater.

The rotor stays round; it wants to seal all around on its circumference, on each end. At the same time the upper sector of the body bore, frustoconical when shaped at ambient temperature, takes on an oval section profile when the valve body reaches thermal equilibrium in operation. The non-uniform temperature profile thus prevented the rotor from sealing at the seal edges in the lower sector, because the rotor grows, radially, from heating—more than the surrounding body—and had to be pulled back axially to the last contact position, which is in the cooler upper sector of the body. Pulling the rotor back axially (thereby increasing the rotor-to-body clearance at the bottom) to compensate would make the leakage into the end-bell cavities worse.

The rotor contact first taking place at the top of the bore apparently led Bauer to surmise that the rotor had been deflected and at least to determine the rotor needed to be moved into the lower sector to mitigate the leakage (at the bottom) into the end-bell cavities, during the break-in or wear-in period.

In accordance with the present disclosure, the rotor axis of rotation should be located on the primary bore axis. As defined in the claims which form a part of this disclosure, the interior mating surfaces of the housing, or body, of such a rotary valve should be shaped when at normal ambient temperature during manufacture or overhaul to have a non-circular internal section shape that will become circular when the valve reaches its normal stabilized operating temperature profile, so that the rotor will fit the body with relatively little break-in wear being needed.

The body or housing can thus be prepared so that a minimum amount of break-in time is required for the rotor and body bore to wear in to fit against each other when the valve has reached equilibrium at its operating temperature and temperature distribution.

In general terms, this is accomplished by shaping the interior surfaces of the body bore of the housing, with the housing at ambient temperature, so that with the rotor located with its axis of rotation in the designed location the rotor clearance in the upper half or sector of the bore is greater than that in the lower sector of the bore, with the difference in clearance being equal to the difference in thermal expansion of the bore in the top sector or half of the body, relative to the thermal expansion of the bore in the bottom sector or half as a result of the different temperature increases of the different portions of the valve body between ambient temperature and operating temperature of the valve.

In one embodiment of the method disclosed herein a valve body may be prepared by first cutting or grinding the body to form an initial bore with interior surfaces symmetrical about the axis of rotation of the rotor, and then removing additional material from the interior of the valve body to form an enlargement of the initial interior bore, of the same size and shape as the initial bore, centered about an axis parallel with the axis of rotation of the rotor but displaced toward the inlet side of the body by a distance related to the difference in temperatures between the inlet side and outlet side of the valve in stabilized operation.

As a further refined variation, the bore of the body of the valve can be adjusted to a slightly different cone angle to account for the slightly greater enlargement of the larger end of the rotor as it is heated to operating temperature.

The foregoing and other features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
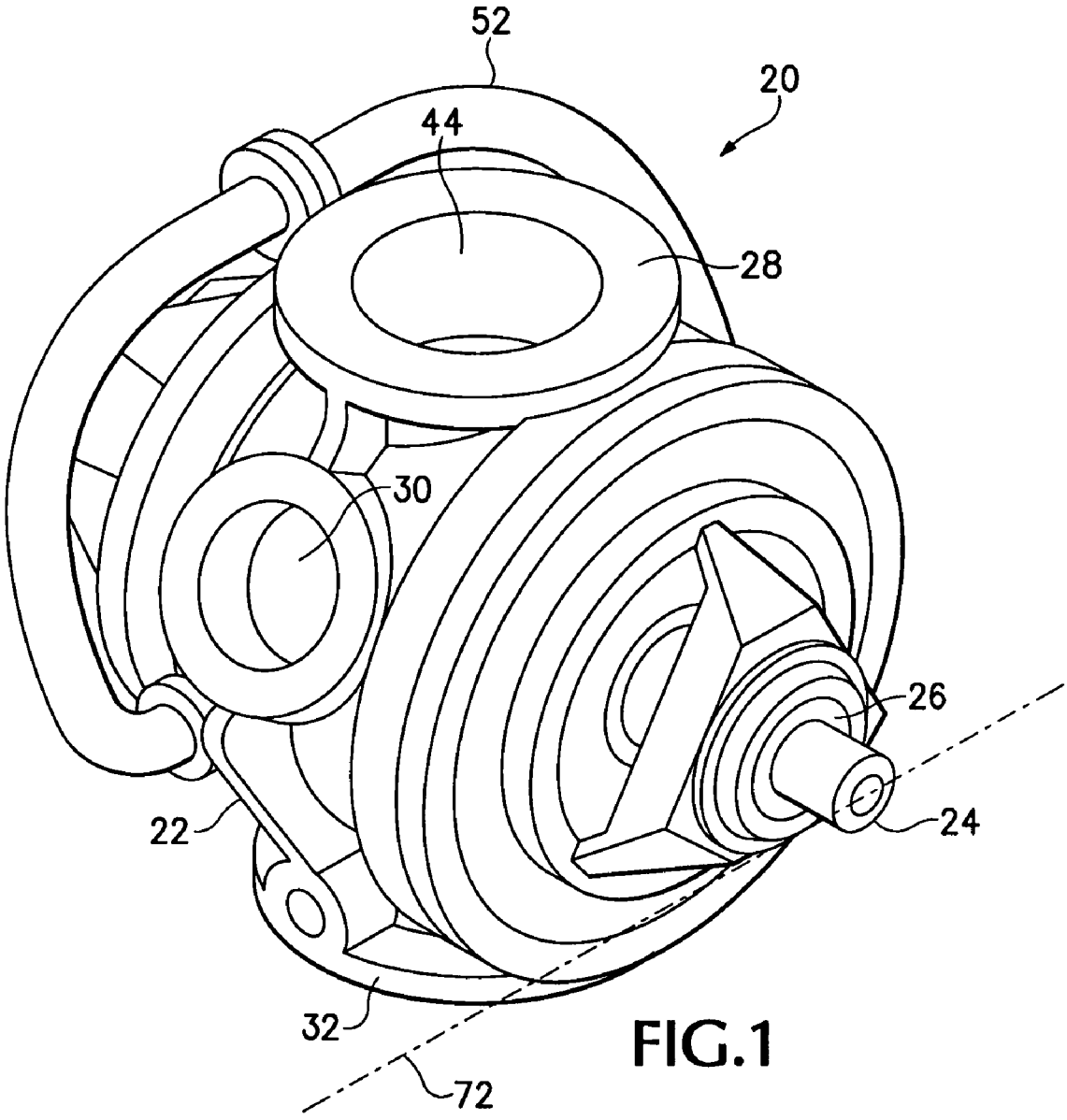
FIG. 1 is an isometric view of a tapered high pressure rotary feed valve of a type typically used for feeding wood chips and sawdust into a pulp digester in the process of making paper.

Referring to the drawings which form a part of the disclosure, FIG. 1 shows a tapered rotary feed valve 20 having a housing or body 22 and a rotor including a shaft 24 of which the ends are carried by radial bearings 26. The valve body 22 has an upper, or inlet side 28 that may include a flange or other fitting to receive a conduit carrying a flow of material such as wood chips to be fed through the feed valve 20. An exhaust port 30 may be provided to relieve pressure from within the body 22. A bottom or outlet side 32 may include a flange by which to mount the valve 20 on a top of a container of material kept at an elevated temperature and pressure, into which the valve 20 may be used to continuously feed additional particulate material.

Figure 2:
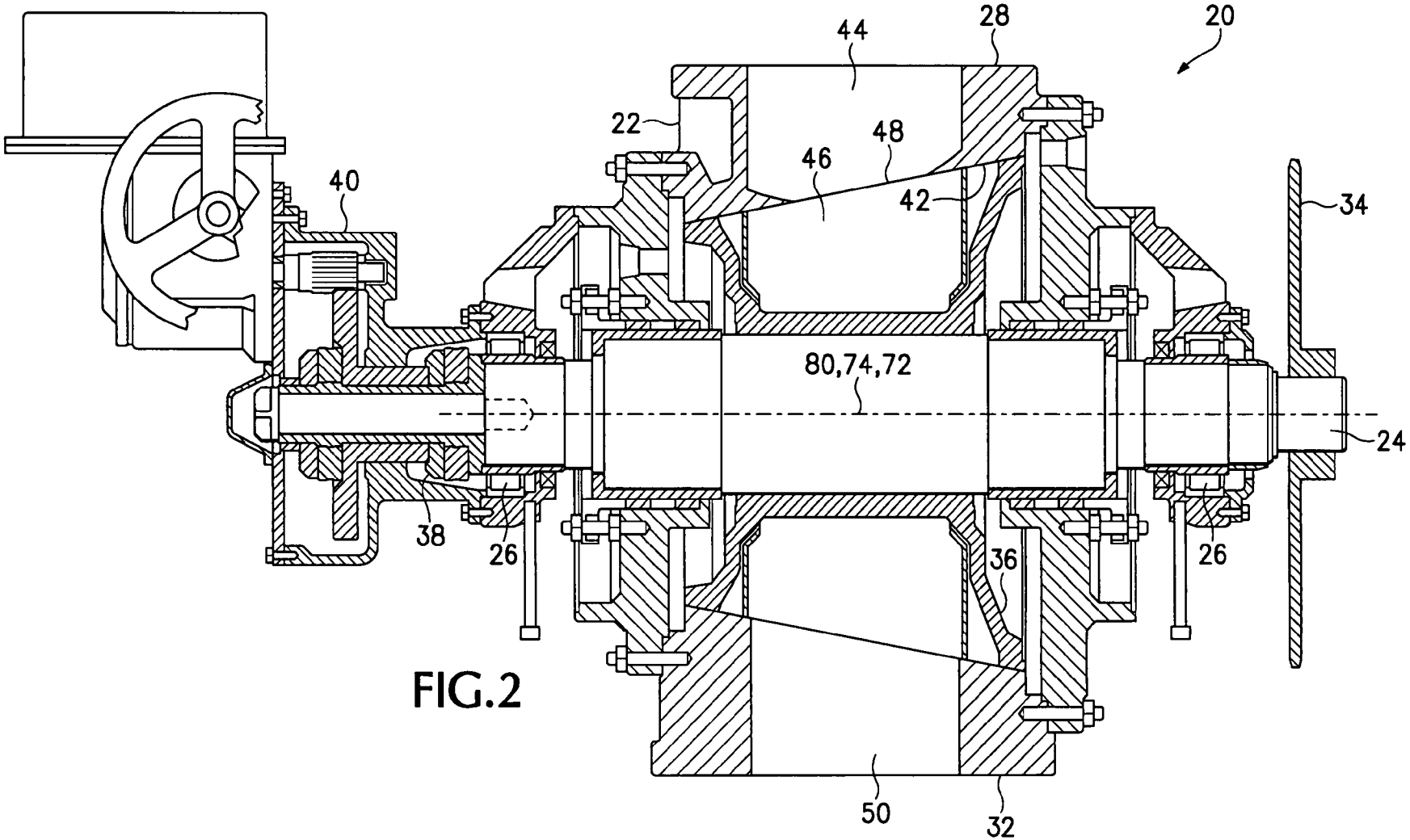
FIG. 2 is a sectional view, taken along the central axis of rotation of the rotor, of a valve such as the one shown in FIG. 1, showing drive and rotor position adjustment mechanisms.

As shown in FIG. 2, the valve 20 may have a sprocket 34 mounted on the shaft 24 to rotate the tapered rotor 36 within the body 22. A thrust bearing 38 is adjustable by a mechanism 40 to move the rotor 36 axially relative to the body 22. The body 22 has a tapered frustoconical interior bore 42 shaped to receive the rotor 36, desirably with a uniform very small radial clearance all around when the valve 20 is in continuous operation and stabilized thermally.

Figure 3:
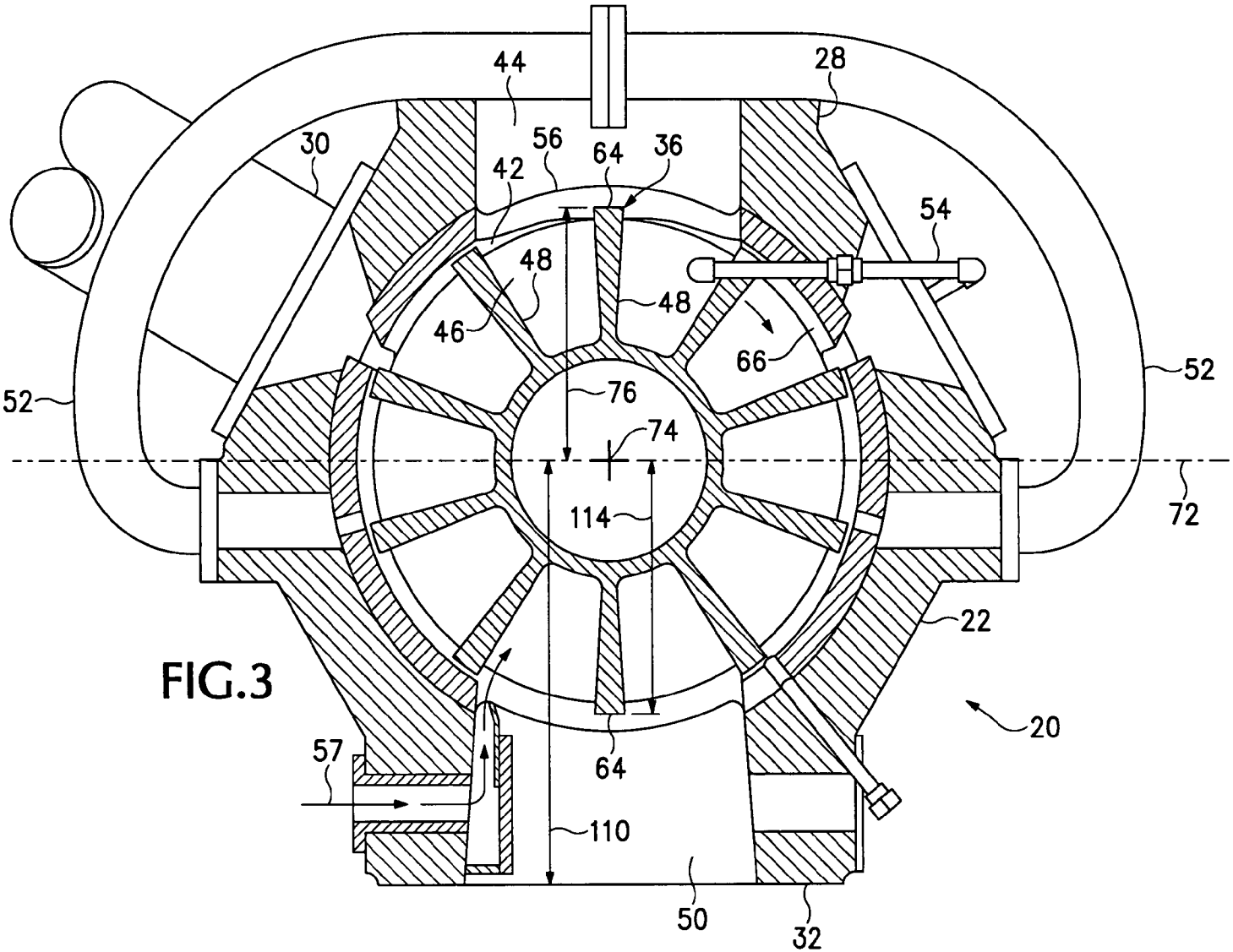
FIG. 3 is a simplified transverse sectional view of the valve shown in FIG. 2, taken along line 3-3 in FIG. 2.

As may be seen with reference also to FIG. 3, an inlet port 44 admits material to be carried in pockets 46 defined by vanes 48 as the rotor 36 turns in the body 22. The material drops from the pockets 46 through an outlet port 50. While a pressure balancing transfer equalizer pipe 52 and end bell relief line 54 may be provided to carry some pressurized gas to pockets 46 moving toward the outlet port 50, it is still important to have minimal clearance between peripheral mating surfaces of the rotor 36 and the interior surfaces of the bore 42. As shown in FIG. 3, the body 22 may include a replaceable liner 56 defining the bore 42, or the interior surfaces of the bore 42 may be defined in a linerless body 22 as shown in FIG. 2.

For clearing material from the pockets 46, purge steam can be admitted as shown by the arrow 57. Purge steam may in some cases be used to heat the valve 20 in preparation for operation, although the valve is best heated by absorbing heat from the digester or other vessel on which it is to be used, with the rotor 36 being rotated during the warm-up of the valve 20, to ensure that the rotor 36 is heated evenly and stays round and straight.

As an example, in a high pressure rotary feed valve manufactured by Bauer, the type of valve described herein and in the Starrett patents mentioned above, the rotor 36 is stainless steel and the body 22 is of mild steel.

These metals have different thermal coefficients of expansion. The net difference, in inches, of thermal expansion between these two metals in such a rotary valve is $3.5\times10^{-6}$ times the temperature change in degrees Fahrenheit times the original dimension in inches, where the greatest growth takes place with the stainless steel.

The top side of the interior bore 42 of the body, that is, the inlet side 28 of the body 22, is cooler than the bottom, or outlet side 32, in a valve in use in a pulp digester or other hot, pressurized container, by a significant temperature difference.

This sets up the top side for interference between the rotor 36 and the internal surfaces of the bore 42 on initial valve warm-up of about 0.022 inch to 0.030 inch measured radially with respect to the shaft (actual values depend on warm-up rate) based on the differential thermal expansion of the body as compared to the rotor.

The reason for this interference was previously misinterpreted as caused by deflection of the rotor due to pressure. However, different temperatures are found in pulp digesters operated at different pressures and the various temperatures explain the historically recommended downward rotor shaft offset range of 0.012" to 0.040" as noted in Bauer documentation.

In actuality, the rotor had not been displaced or deflected by pressure and was still on center with the original bore shape in the lower sector of the bore. The surfaces of the rotor were thus actually congruent in the lower sector before downward relocation of the rotor axis.

Figure 4:
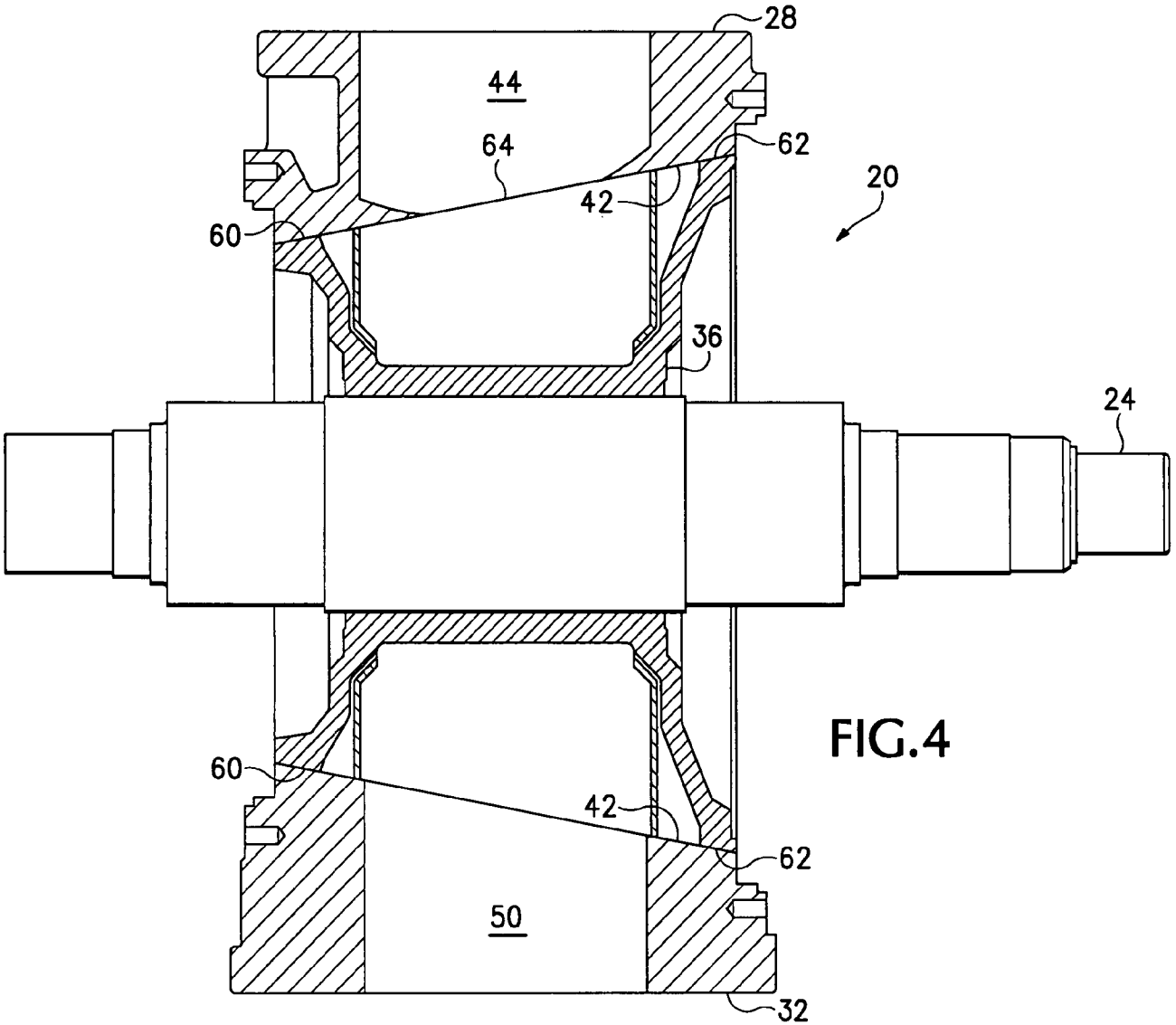
FIG. 4 is a simplified sectional view of the valve shown in FIG. 2 with its rotor fully seated in a sealing condition, with the valve body stabilized at operating temperature.
Figure 5:
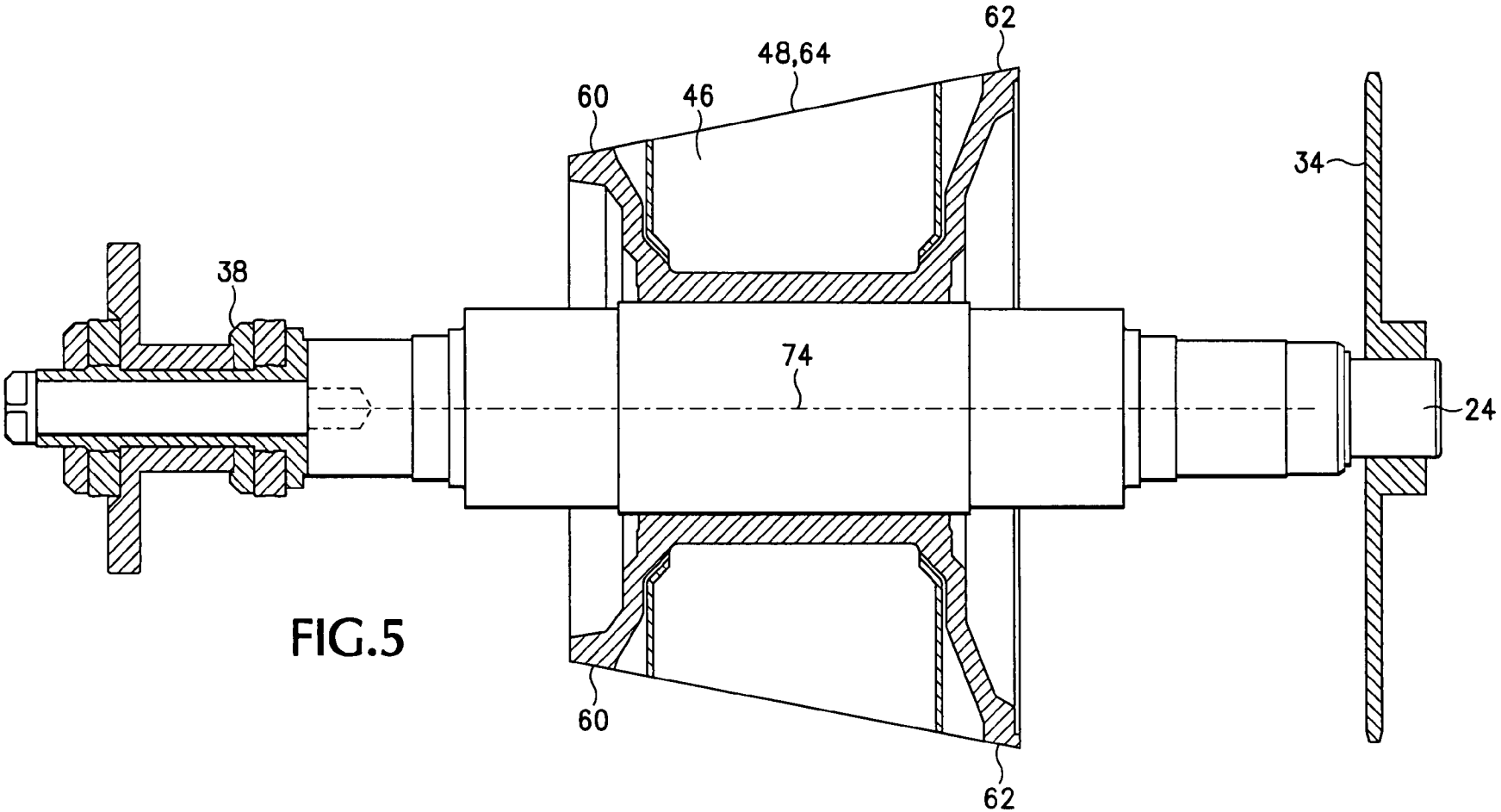
FIG. 5 is a simplified sectional view of the rotor of the valve shown in FIG. 2, showing the drive sprocket and the thrust bearing.

However, the rotor 36 stays round, symmetric about its axis of rotation, because it rotates over the heat source and is heated uniformly and equally to the vessel temperature. The "round" (heated) rotor 36 will have to wear-in all surface contacts in the body bore 42 as shown in FIG. 4 until the peripheral end sealing surfaces 60, 62, and the outer edges 64 of the vanes 48 (FIG. 5) mate in a round bore symmetrical about the rotor axis of rotation when the valve 20 is operating continuously at thermal equilibrium as shown in FIG. 4.

For the tapered rotor 36 to seat sealingly, it is necessary for the body bore 42 to be worn to fit the rotor 36, by bringing the rotor 36 into contact with the interior surfaces of the bore 42 of the body 22.

Moving the rotor 36 axially to get clearance for the rotor 36 inside the cooler inlet side 28 of the bore 42 of the warming body 22 also increased the already larger clearance between the rotor 36 and the interior surface of the bore 42 on outlet side 32 of the body. Downwardly relocating the rotor 36 brought the rotor 36 closer to the bore surfaces in the lower sector and farther from the bore surfaces in the upper sector, or inlet side 28, but eventual thermal stability does not change the incongruity caused by the offset. Wear-in then required more wearing-in of a larger misaligned fit area in the lower sector, near the outlet side 32, in a valve 20 with its rotor 36 located eccentrically as recommended by Bauer.

In any case, the question is not whether wear-in will be required, it is a matter of how much and how much time.

The previously used downward offset of the rotor axis of rotation set up a condition where more wear-in had to take place in both top and bottom of the bore 42. An ovality of the upper bore sector resulted from the thermal profile, and that shape had to change. Using a downward offset of the rotor axis thus initially brings the rotor 36 closer to the interior of the bore 42 in the bottom, outlet side 32 of the body 22, but it increases the amount of wear-in required in the bottom sector.

Revising the shape of the bore 42 in a Bauer valve at ambient temperature as disclosed herein has the effect of reducing the amount of required wear-in and reducing the time needed for wear-in until the rotor 36 fits the bore 42 during operation at thermal equilibrium. In order to prepare a new or refurbished tapered high pressure rotary feed valve as disclosed herein, the rotor 36 should be parallel to and coexistent with the central, primary axis of the bore 42.

Need for liner replacement or bore re-buildup (in the case of linerless valves) is reached early in tapered rotary valves prepared in accordance with the manufacturer's specifications because of restoration regrinds performed according to the manufacturer's specifications, not due to axial advancement of the rotor 36 to account for wear over the lifecycle of the valve 20 as is sometimes perceived. Each such regrind reestablishes the original bore and offset rotor relationship at ambient temperature. This repeating restoration and following break-in wear eventually used up all the available (about one inch) axial travel of the rotor 36 and the thrust bearing adjustment mechanism 40.

In order to reduce rotary feed valve break-in time and energy costs according to the present disclosure, the bore 42 is made to provide greater radial clearance in the upper sector 66 at ambient temperature, the temperature at which the valve 20 is machined, normally the temperature in a machine facility, for example 60° F. Although the rotor-to-bore fit can be improved to account partially for temperature distributions, manufacturing tolerances are too imprecise for achieving a satisfactory fit based on machining and grinding alone. One may come close to an ideal start-fit based on the present disclosure. However, there is no substitute for the lapping-in process at thermal equilibrium, for the specific application. In fact, under any conditions, a Bauer-type tapered rotary feed valve is going to need some wear-in to seat properly.

The wearing-in, or seating, process is a matter of doing work on the mating parts until they fit. The time required for startup and reaching fully seated (worn-in) status is dependent on the work needed, and the present disclosure is intended to minimize that work.

Figure 6:
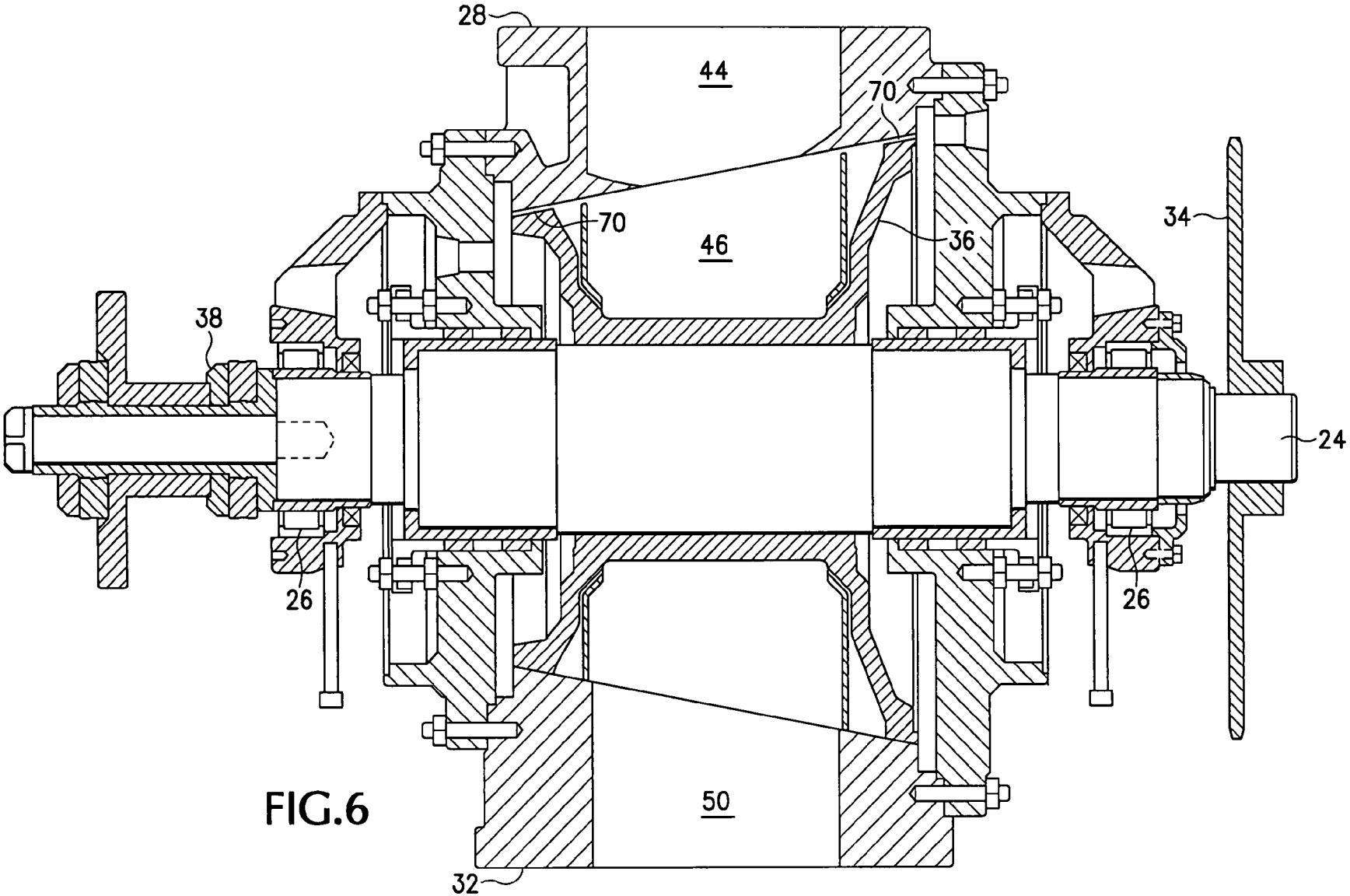
FIG. 6 is a sectional view of a valve prepared according to the present disclosure, at ambient temperature.
Figure 7:
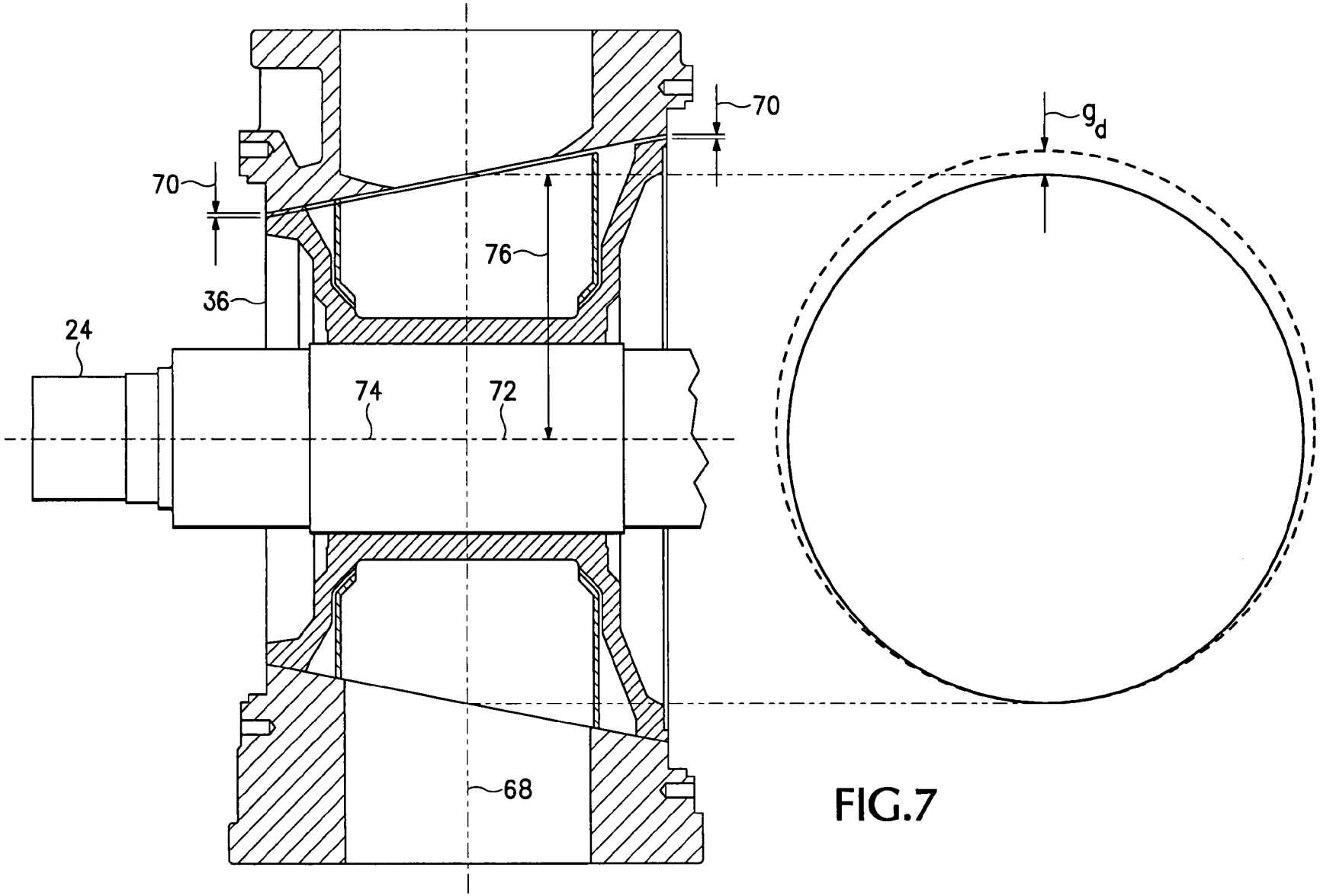
FIG. 7 is a simplified view of the valve shown in FIG. 6, together with a diagram of the shape of the interior bore at a location along the length of the valve.
Figure 8:
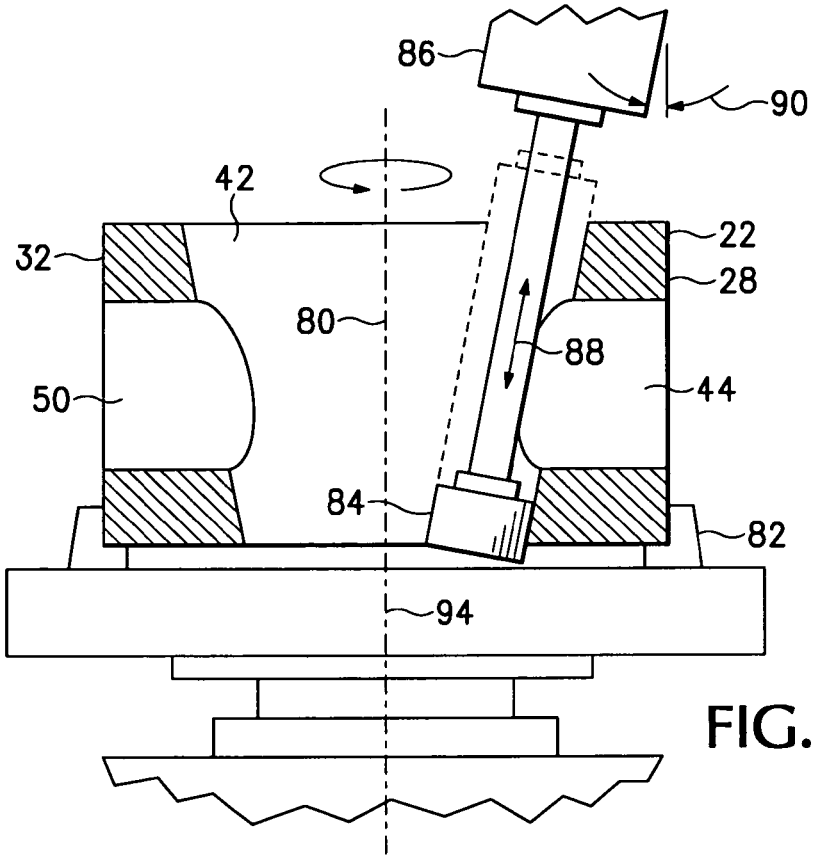
FIG. 8 is a simplified view showing a valve body in sectional view mounted in a chuck for rotation of the valve body about the axis of rotation of the valve rotor shaft as a grinder shapes the interior mating surfaces of the valve.
Figure 9:
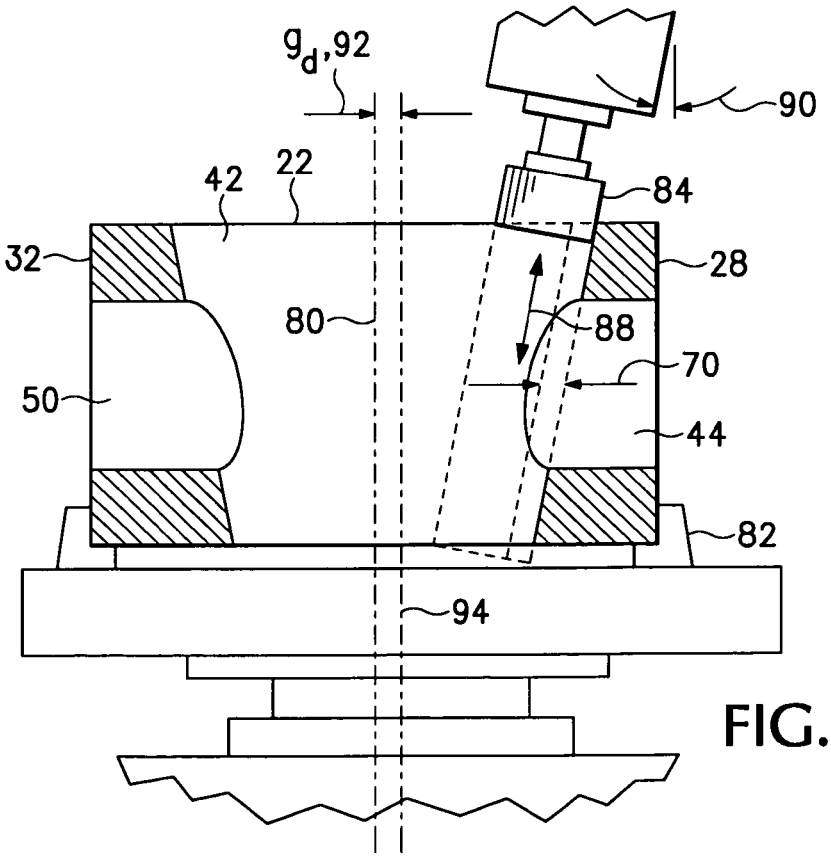
FIG. 9 is a view similar to FIG. 8, showing the valve body adjusted in the chuck to rotate the valve body about an offset axis parallel with the axis of rotation of the rotor shaft, while a second grinding operation is performed.

In order to establish a worn-in fit between the rotor 36 and the body bore 42 at thermal equilibrium as promptly as possible, and with the least detractions such as acute end-bell plugging, blow-by, and excessive horsepower consumption, the bore 42 can be prepared as disclosed herein at ambient temperature so that it will be uniformly round and symmetrical about the rotor 36 when at thermal equilibrium. This requires the upper sector of the bore 42 to provide additional clearance radially when the valve 20 is at ambient temperature, as shown in FIGS. 6 and 7.

For determining the amount of additional clearance to cut into the upper part 66 of the tapered bore 42 of a Bauer-type tapered bore high-pressure rotary feeder valve 20 (HPRFV), the following procedure may be used. Because the rotor 36 and body bore 42 must match during operation, and the fit is tapered, reference can be made to a hypothetical "slice" plane 68 with a diameter inside the bore 42 of 32 inches about half way along the axial length of the rotor 36. The desired amount of an offset radial enlargement 70 of the upper part 66 of the bore 42, in the cooler, inlet side 28 portion of the body 22, can be determined as follows:

First, compile a set of temperature readings on HPRFVs of like size in use in the place where the HPRFV to be prepared is to be installed.

Observe that the lower half of a HPRFV is nearly uniform in temperature and close to the same temperature as the heated pressurized vessel, such as a pulp digester vessel, because of the way the steam vapors are effectively circulated in a loop because of the side exhaust outlet 30 and equalizer lines 52, etcetera.

Note the temperature differential across the zone from the mid-height plane 72 of the valve body 22 to the top of the slice, on the inlet side 28 of the body.

Note the coefficient of expansion properties of the body material versus the rotor material.

Note that the temperature of the rotor 36 is uniform and is close to the temperature of the pressurized vessel on which the HPRFV 20 is used. This is because the rotor 36 rotates over the heat source and is uniformly heated. The rotor 36 therefore remains round in any transverse section as in FIG. 3.

The rotor 36 obtains its fit relation to the body-bore 42 by the fact that the rotor 36 is able to be moved axially in either direction by the adjustable thrust bearing arrangement 38, to compensate for the differential of thermal growth of the rotor 36 with respect to the body material, and so that clearances can be maintained over the long term during operation of the HPRFV 20.

Next, average the temperature of the body 22 from the height of the horizontal center plane 72, extending through the rotor axis 74, to the top of the bore 42 at the location of the slice, at a condition of operation at thermal equilibrium.

On the basis of the difference between that average temperature and the nearly uniform temperature between the center plane 72 and the bottom or outlet side 32 calculate the theoretical differential amount the radius 76 of the bore 42 will grow on the plane 68. The calculation is based on the formula: $g_d=(C_e)(t_a-A)(d_r)$=the needed additional clearance, where $g_d$ is the differential growth in the radius of the upper part of the bore versus the bottom part of the bore, where $C_e$ is the coefficient of thermal expansion of the body material, $t_a$ is the average temperature value as noted above; A is the ambient temperature; and $d_r$ is the radial distance 76 at the slice plane 68. The bore is then shaped, at ambient temperature, to be slightly oblate, using $g_d$ (shown greatly exaggerated in FIG. 7) as the value of an offset enlargement that will be ground into the upper sector of the bore, as follows.

Securing the valve body 22 appropriately in a suitable chuck associated with a precisely controllable grinder (or other suitable cutting tool) the first grind is to form a frustoconical bore that is held true and concentric to the initial axis 80 of rotation of the bearing seats of the body, and which establishes the base location for positioning the rotor 36 axially. A large vertical-axis chuck 82 may be used to rotate the valve body 22 about the axis 80 while a grinder wheel 84, or other suitable cutter, mounted on a head that is controllably movable in or out as indicated by the arrow 88, and adjustable to the required angle 90 relative to the vertical axis 94 of rotation of the chuck 82, forms the interior surface of the initial or first grind bore. The intent is to be able to drop the finished rotor 36 into the first-grind bore (at ambient temperature) and have it fit the body 20 (within the specified axial position range) so one cannot slide a feeler gage larger than 0.0015" into the gap between the rotor and the body at the sealing surfaces 60, 62 on either end. This is defined as a "match," within tolerance.

After the first-grind is complete and tested as described, then the entire valve body 22 is shifted in the chuck until it is positioned so a dial indicator shows the first-grind bore axis 80 to be shifted by a distance equal the calculated offset $g_d$, in the direction away from top-dead-center of the inlet side 28, relative to the grinding wheel.

For clarification: let the movement of the body on the machine chuck be defined as X & Y; let the axis of the bore be defined as the same axis coincident to the centerline of the bearing housing as the Z axis. Therefore, when the grinding head 80 is moving the grinder wheel 84 in or out, it is traveling at the angle 90 to, but in the same direction relative to the Z axis (Z direction).

Next, the grinder wheel 84, which is still in its original position relating to the chuck center axis 80 as when first grind took place, is started. The body 22, now in its shifted position, is ground by rotating the chuck 82 about its axis 94 without moving the grinder head 86 relative to the original axis of rotation 94 of the chuck. This is referred to as the second grind, and results in additional rotor clearance 70 in the upper half of the tapered body bore 42, in the direction and an amount equal to the distance 92 by which the valve body 22 was moved in the chuck 82.

Figure 10:
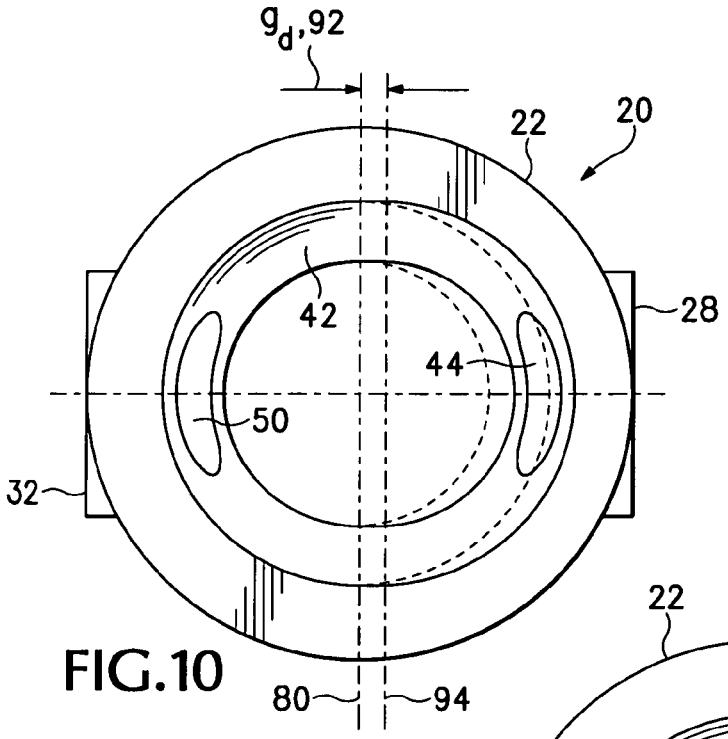
FIG. 10 is a sectional view of the valve body taken along line 10-10 in FIG. 9, showing the effect of the second grinding operation.
Figure 11:
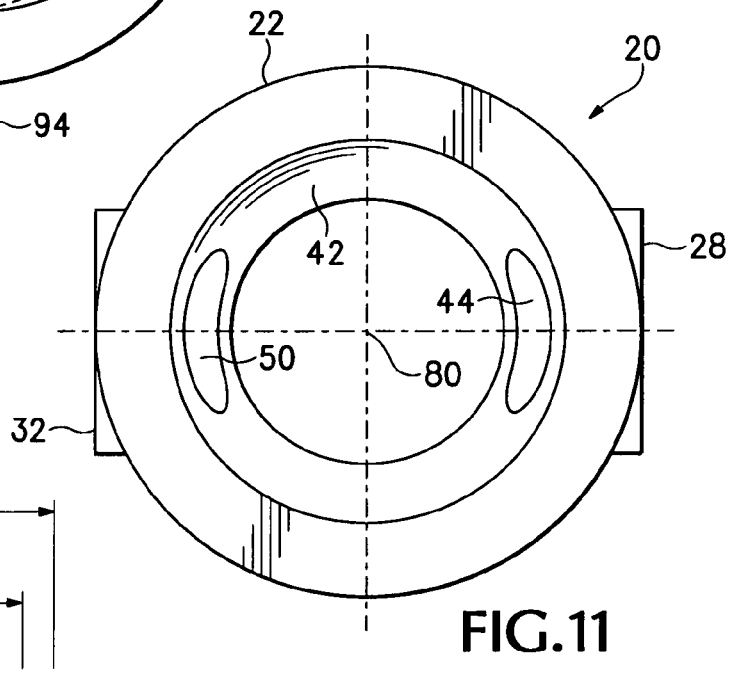
FIG. 11 is a sectional view similar to FIG. 10, showing the circular shape of the interior bore of the valve body once it has reached a stable operating temperature.

As the chuck rotates the body with the axis 80 of rotation of the bearing seats offset from the axis of rotation 94 of the chuck by the calculated distance 92 away from the top dead center of the inlet side 28, the second-grind cuts out the upper sector of the bore 42 by the amount of the calculated offset, as may also be seen in FIG. 10. Looking at the slice-line plane of reference 68, this effectively removes the metal from the body 22 that would otherwise result in the shorter radius in the bore 42 at operational thermal equilibrium as noted above because of the lower temperature in the upper, inlet side 28 of the valve body 22. The second-grind is subtle and the blend of surfaces is not easily detectable. Therefore, when the body 22 heats up (based on the data and calculated value), the bore 42 assumes a near perfect round frustoconical shape, shown in end view in FIG. 11, at hot equilibrium temperature. This allows the rotor 36 to mate with the body 22 much more quickly, and with less axial movement of the rotor 36 than was required previously using downwardly eccentric placement of the rotor 36, and the hot equilibrium shape of the bore 42 thus shaped fits the hot round rotor 36 closely within a time that may be as short as half an hour after the valve reaches thermal equilibrium. A valve whose frustoconical bore 42 is thus modified at ambient temperature quickly provides a superior all around rotor to body fit, and an improved seal on startup.

As an example, growth of the body over distance 110 in FIG. 3 is:

$$(6.5\times10^{-6})\left(\left(\frac{254+312}{2}\right)-60\right)(27)=0.0391''$$

The 60 represents ambient temperature; when subtracted from average of temperatures from the outlet side 32 to the height of the plane 72 at the axis of rotation of the rotor 36 this gives the average temperature change affecting the metal of the body 22, below the plane 72. The distance 110, for example is 27 inches at ambient temperature.

The growth of the radius 76 inside the bore 42, based on a radius of 16 inches at ambient temperature, a temperature of 247° F. at the outlet side 28, and a temperature of 254° F. at the mid-height plane 72, is calculated as:

$$(6.5\times10^{-6})\left(\left(\frac{254+247}{2}\right)-60\right)(16)=0.0198''$$

Similarly the growth of radius 114 inside the bore 42 between the midheight plane 72 and the bottom of the bore 42 at the location of the 32 inch diameter slice (at ambient temperature) is calculated as:

$$(6.5\times10^{-6})\left(\left(\frac{254+312}{2}\right)-60\right)(16)=0.0232'',$$

where the ambient temperature is 60° F., the temperature at the midheight plane 72 is 254° F. and the temperature at the bottom of the bore 42 is 312° F.

The difference between the expanded radii 76 and 114 is thus 0.0232"−0.0198"=0.0034"' and in order for the rotor to fit then, 0.0034" must be removed from the roof of the body bore 42 at the location of the 32" diameter slice.

However, the rotor 36 grows at a greater rate than the body 22, because of different material. The rate difference is $3.5\times10^{-6}$ in/in/deg F. Therefore, the rotor 36 will have to be withdrawn axially an appropriate distance.

Thus, for this example the basic radial size increase needed at the top of the body, to compensate for thermal variation, would be approximately 0.004". Allowing for the included cone angle variation would add a few more thousands of an inch, and the total may be used as the offset distance 92 by which the valve body 22 is shifted in the chuck 82, but each case is slightly different because the vessel temperature and the resulting temperature profile in the valve body would also be different.

Figure 12:
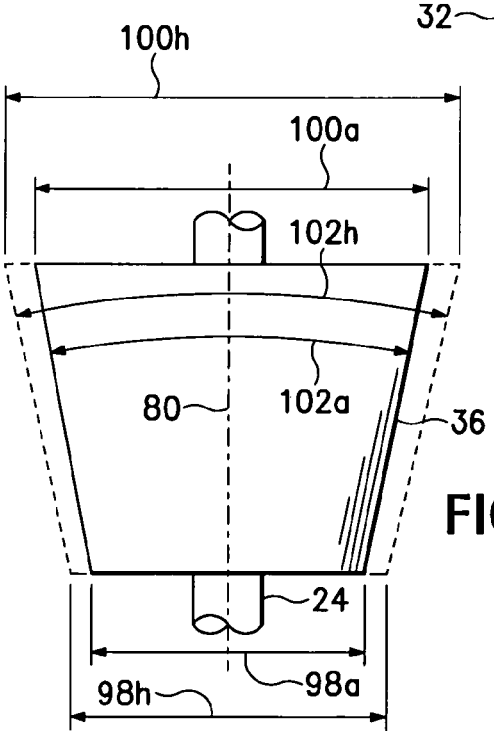
FIG. 12 is a simplified view of a rotor to show thermal expansion thereof.

As a further refinement of the process of shaping the bore 42 at ambient temperature during manufacture or refurbishment of a rotary feed valve 20, the change in cone angle of the frustoconical shape of the rotor 36 as a result of temperature change may be considered. By considering the diameter 98*a* of the rotor 36 at its small end and the diameter 100*a* of the rotor 36 at its large end at ambient temperature, the difference in thermal expansion of each end between the ambient and operating temperatures, to the diameters 98*h* and 100*h*, can be used to calculate the expected change in shape. That is, as shown in FIG. 12, with a cone angle 102*a* at ambient temperature, a slightly larger cone angle 102*h* can be predicted for the rotor 36 when warmed-up to its operating temperature, and the bore 42 can be shaped as explained above, but to the shape required when at ambient temperature to provide the frustoconical shape of the hot rotor 36 when the valve body 22 is at its thermal equilibrium operating temperature, taking into account the difference, if any, in the coefficient of thermal expansion of the material of which the body 22 is made from the coefficient of thermal expansion of the rotor 36, in determining the necessary angle 90 for use in a grinding or cutting machine 86.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A tapered rotary feed valve for feeding material into a container having an elevated operating temperature, comprising:

(a) a rotor having a shaft and peripheral mating surfaces defining a frustoconical rotor shape; and (b) a housing having an inlet side and an outlet side and including internal rotor-mating surfaces defining an initial bore shape approximating the frustoconical rotor shape, but wherein said initial bore shape differs from the rotor shape, when the housing is at an ambient temperature lower than the elevated operating temperature of said container, by being larger in radial dimension than the frustoconical rotor shape in portions of the housing closer to the inlet side than to the outlet side, yet more closely approximating said frustoconical rotor shape in portions of the housing closer to the outlet side than to the inlet side.

2. The tapered rotary valve of claim 1 wherein the initial bore shape is larger in radial dimension in the portions of the housing closer to the inlet side than to the outlet side by an amount related to a temperature difference between the inlet side and the outlet side of the valve.

3. A method of preparing a tapered rotary feed valve for use in continuously feeding material at a first, lower, temperature into a container containing material at a second, higher temperature, comprising:

(a) determining expected temperatures of an inlet side and an outlet side of a valve body in an operational equilibrium condition;

(b) determining an amount of difference in thermal expansion of a valve bore radially from a rotor axis of rotation, between the inlet side and the outlet side between an ambient temperature and the expected temperatures in the operational equilibrium condition;

(c) determining an expected amount of thermal expansion of a rotor intended to mate rotatably with the valve bore between the ambient temperature and an expected rotor temperature in the operational equilibrium condition;

(d) shaping the valve body to define an initial valve bore at the ambient temperature to have a frustoconical valve bore shape that is symmetrical about a rotor axis of rotation and fits the rotor closely at the ambient temperature;

(e) enlarging the valve bore at the ambient temperature by removing material from a portion of the valve body closer to the inlet side of the valve body, forming an ovate shape as seen in sectional view in a lane normal to the rotor axis of rotation when at the ambient temperature and that will result in the valve bore changing to a frustoconical shape with a circular shape as seen in sectional view in the plane normal to the rotor axis of rotation when the valve is in the operational equilibrium condition.

4. The method of claim 3 wherein the step of enlarging the valve bore includes removal of material to form a second grind bore surface offset toward the inlet side of the valve body, the second grind bore surface having a shape similar to the shape of the initial valve bore relative to an axis parallel with the rotor axis of rotation and offset toward the inlet side of the valve body.

* * * * *